US007591037B1

(12) United States Patent
Strickland

(10) Patent No.: US 7,591,037 B1
(45) Date of Patent: Sep. 22, 2009

(54) FOUR-IN-ONE MULTI-COMPONENT COMBINATION TOOL TO FACILITATE FORMING AND SEALING CARTONS AND BOXES

(75) Inventor: Scott Strickland, Pomona, CA (US)

(73) Assignee: Carmen Alvarado-Biswell, Pomona, CA (US), part interest ( * ) Notice: Subject to any disclaimer, the term of this patent is extended or adjusted under 35 U.S.C. 154(b) by 0 days.

(21) Appl. No.: 12/157,759

(22) Filed: Jun. 13, 2008

(51) Int. Cl.
*B25F 1/00* (2006.01)
*B26B 11/00* (2006.01)

(52) U.S. Cl. ..... 7/160; 7/156

(58) Field of Classification Search ..... 7/160, 7/163, 158, 167, 103, 105, 119, 156
See application file for complete search history.

(56) References Cited

U.S. PATENT DOCUMENTS

| | | | | |
|---|---|---|---|---|
| 80,780 | A * | 6/1868 | Standish | 7/160 |
| 3,596,820 | A | 8/1971 | Lou | |
| 4,625,901 | A | 12/1986 | Adelizi | |
| 4,727,610 | A | 3/1988 | Lin | |
| 4,783,867 | A * | 11/1988 | Tsao | 7/160 |
| 4,934,527 | A * | 6/1990 | Ho | 206/224 |
| D333,678 | S | 3/1993 | Lissoni | |
| 5,477,601 | A | 12/1995 | Jasmer | |
| 5,911,761 | A | 6/1999 | Tilley | |
| 6,273,582 | B1 | 8/2001 | Taggart et al. | |
| 6,286,745 | B1 * | 9/2001 | Ackeret | 7/160 |
| 6,705,373 | B1 | 3/2004 | Chen | |
| 6,913,368 | B2 | 7/2005 | Leu | |
| 6,941,604 | B2 | 9/2005 | Ackeret | |
| D520,061 | S | 5/2006 | Daunter et al. | |
| D524,616 | S | 7/2006 | Cetera | |
| 7,143,922 | B2 * | 12/2006 | Shevin-Sandy | 7/160 |
| D541,609 | S | 5/2007 | Nuttal et al. | |
| 7,237,340 | B2 | 7/2007 | Johnson et al. | |
| D564,592 | S | 3/2008 | Kwok | |
| 2003/0066137 | A1 | 4/2003 | Johnson et al. | |
| 2006/0218826 | A1 | 10/2006 | Cetera | |
| 2007/0124866 | A1 | 6/2007 | Grepper | |
| 2007/0261174 | A1 | 11/2007 | Barker | |
| 2008/0000031 | A1 | 1/2008 | Delneo et al. | |
| 2008/0023581 | A1 | 1/2008 | Sandy | |
| 2008/0053622 | A1 | 3/2008 | Huang | |

FOREIGN PATENT DOCUMENTS

| | | |
|---|---|---|
| EP | 1707320 | 4/2006 |
| FR | 1 707 320 | * 10/2006 |

* cited by examiner

*Primary Examiner*—Hadi Shakeri
(74) *Attorney, Agent, or Firm*—Thomas I. Rozsa

(57) ABSTRACT

A four-in-one multi-component combination tool which has a combination of four features all combined into one tool to facilitate enclosing cartons and boxes such as parcel packages and also has the added features of a box cutter to cut up unused boxes and also a marker to mark the box or package after it is enclosed. The invention includes a tape roll assembly, a built-in extendable and retractable blade knife which functions as a box cutter, a stapler and an extendable and retractable marker, which are integrated to effectively and conveniently assist in packaging activities.

1 Claim, 6 Drawing Sheets

FOUR-IN-ONE MULTI-COMPONENT COMBINATION TOOL TO FACILITATE FORMING AND SEALING CARTONS AND BOXES

BACKGROUND OF THE INVENTION

1. Field of the Invention

The present invention is related to a tool for use in packaging and more particularly, to a combination tool used for assisting in packaging parcel packages. The present invention relates to a combination tape dispenser, stapler, box cutter and marker for assisting a packager with preparing a shipping container.

2. Description of the Prior Art

When cargo is packed in a shipping container, a packager initially uses a tape dispenser to seal the container with the appropriate length of tape. Additionally, the worker often staples the box and subsequently writes an address or other information thereon. Such tasks require the use of four separate tools. Repeatedly retrieving and releasing multiple tools is laborious and time consuming. Accordingly, there is currently a need for a more efficient means of packing and shipping cargo. The present invention addresses this need by providing a tool that includes a tape dispenser, a stapler, a box cutter and a marker.

The following 24 patents are relevant to the field of the present invention.

1. U.S. Pat. No. 3,596,820 issued to Kwong Li Lou on Aug. 3, 1971 for "Stapler" (hereafter the "Lou Patent");

2. U.S. Pat. No. 4,625,901 issued to Nicholas J. Adelizi on Dec. 2, 1986 for "Multi-Blade Tape Dispenser" (hereafter the "Adelizi Patent");

3. U.S. Pat. No. 4,727,610 issued to Johnny C. H. Lin on Mar. 1, 1988 for "Multi-Purpose Stapler" (hereafter the "Lin Patent");

4. U.S. Design Pat. No. Des. 333,678 issued to Adelio Lissoni and assigned to S.I.A.T. Societa Intemazionale Applicazioni Techniche S.p.A. on Mar. 2, 1993 for "Hand-Held Adhesive Tape Dispenser (hereafter the "Lissoni Patent");

5. U.S. Pat. No. 5,477,601 issued to Arthur P. Jasmer on Dec. 26, 1995 for "Combination Staple Gun And Cutter And Method of Use" (hereafter the "Jasmer Patent");

6. U.S. Pat. No. 5,911,761 issued to James F. Tilley on Jun. 15, 1999 for "Combined Stapler And Utility Knife" (hereafter the "Tilley Patent");

7. U.S. Pat. No. 6,273,582 issued to John Merrick Taggart et al. and assigned to Swiss Army Brands, Inc. on Aug. 14, 2001 for "Compact Multi Function Tool" (hereafter the "Taggart Patent");

8. U.S. Published patent application No. 2003/0066137 to Ronald L. Johnson et al. on Apr. 10, 2003 for "Multi-Tasking Utility Tool" (hereafter the "Johnson Published Patent Application");

9. U.S. Pat. No. 6,705,373 issued to Hsiu-Man Yu Chen on Mar. 16, 2004 for "Tape Cutting Device Of An Adhesive Tape Holder" (hereafter the "Yu Chen Patent");

10. U.S. Pat. No. 6,913,368 issued to Ching-Biau Leu and assigned to Neway International Lifetech Corporation on Jul. 5, 2005 for "Ten-In-One Pocket Stationery Unit" (hereafter the "Leu Patent");

11. U.S. Pat. No. 6,941,604 issued to Peter Ackeret and assigned to CTech AG on Sep. 13, 2005 for "Multipurpose Hand-Held Implement Of The Pocket-Knife Type" (hereafter the "Ackeret Patent");

12. U.S. Design Pat. No. D520,061 issued to Dominic Daunter et al. and assigned to Henkel Consumer Adhesives, Inc. on May 2, 2006 for "Ergonomic Tape Dispenser" (hereafter the "Daunter Design Patent");

13. U.S. Design Pat. No. D524,616 issued to Carl Cetera and assigned to Cotapaxi, Inc. on Jul. 11, 2006 for "Combined Tape Dispenser And Stapler" (hereafter the "Cetera Design Patent");

14. U.S. Published patent application No. 2006/0218826 to Carl Cetera on Oct. 5, 2006 for "Tapeleri" (hereafter the "Cetera Published Patent Application");

15. U.S. Pat. No. 7,143,922 issued to Bonni-Shevin-Sandy and assigned to Dard Products, Inc. on Dec. 5, 2006 for "Stapler With Tape Dispenser And Flag Dispenser" (hereafter the "Shevin-Sandy Patent");

16. U.S. Design Pat. No. D541,609 issued to Michael John Nuttal et al. and assigned to Thomas Direct Sales, Inc. on May 1, 2007 for "Combination Stapler/Tape Dispenser" (hereafter the "Nuttal Design Patent");

17. U.S. Published patent application No. 2007/0124866 to Ryan Grepper on Jun. 7, 2007 for "Vertically Standing Stapler And Tape Dispensing Device" (hereafter the "Grepper Published Patent Application");

18. U.S. Pat. No. 7,237,340 issued to Ronald L. Johnson et al. and assigned to Wagic, Inc. on Jul. 3, 2007 for "Multi-Tasking Utility Tool" (hereafter the "Johnson Patent");

19. U.S. Published patent application No. 2007/0261174 to Richard W. Barker on Nov. 15, 2007 for "Modular Tools" (hereafter the "Barker Published Patent Application");

20. U.S. Published patent application No. 2008/0000031 to John Delneo et al. on Jan. 3, 2008 for "Stapler With Blade Carriage For Securing A Blade" (hereafter the "Delneo Published Patent Application");

21. U.S. Published patent application No. 2008/0023581 to Bonni Shevin Sandy on Jan. 31, 2008 for "Tape Dispenser" (hereafter the "Sandy Published Patent Application");

22. U.S. Published patent application No. 2008/0053622 to Harrison Huang on Mar. 6, 2008 for "Tape Dispenser Equipped With Extra Tool" (hereafter the "Huang Published Patent Application");

23. U.S. Design Pat. No. D564,592 issued to Eddie Tak-Chuen Kwok on Mar. 18, 2008 for "Tape Dispenser" (hereafter the "Kwok Design Patent");

24. European Patent Application No. EP 1,707,320 issued to Carl Cetera and assigned to Cotapaxi Custom Design And Manufacturing, LLC on Apr. 10, 2006 for "Combination Stapler With Tape Dispenser" (hereafter the "Cetera European Patent").

The Lou Patent which issued in 1971 and has now expired discloses a combination of a stapler and a tape dispenser. Specifically, the patent discloses:

"Referring to FIG. 1, a stapler is shown comprising a base 13 carrying a baseplate 12 having two upstanding flanges 10 to which a stapler magazine 11 and an actuating lever 9 are pivoted. The actuating lever carries a resilient element 8 to which a staple driver 7 is connected and which serves to return and maintain the magazine 11 and actuating lever 9 in normal spaced relation relative to plate 12. The magazine 11 contains a staple guide 40 and a staple feed spring 41. The actuating lever 9 carries a hand or finger pad 39, and baseplate 12 may have a staple remover 42 secured thereto. The plate 12 carries staple-clenching means 20. All of the foregoing elements are conventional and interact in a well-know manner to feed and set a staple upon manual depression of the pad 39 on lever 9.

A tape holder 14 having an openable cover is attached to the base 13 by a hinge 15. A supply of reinforcing tape 16 in the tape holder 14 passes through a slot (not shown) in the tape holder 14 into the base 13, and through an outlet slot 17, shown in FIGS. 1 and 2."

Therefore, this invention does disclose the combination of a stapler and a tape dispenser.

The Adelizi Patent discloses:

"a tape dispenser to allow multiple rolls of tape, some which are different widths, to be dispensed from a single dispenser without becoming entangled and sticking tot he adjacent tape is disclosed. The dispenser contains two sets of blades spaced apart and attached to the dispenser housing. A guide bar is used adjacent to the lower blade to ensure the tape will approach the blade at an angle that will provide a clean cut. The tapes are placed on a tape core which is slid in an internal groove in the sides of the tape housing. The tapes are then fed to the cutting blades in an alternate manner which minimizes the risk of entanglement when being used."

Therefore, this patent discloses the concept of having the tape dispenser combined with a marking instrument.

The Lin Patent is a multi-purpose stapler which discloses:

"A combination stapler, tape dispenser, hole puncher, pencil sharpener, paper clip holder, and storage compartment. A function plate with a block o n top of it which can be slid back and forth lengthwise along the base of the present invention, so as to set which function can be used, i.e. the stapler or the hole puncher. The hole puncher has a scale so as to allow for accurate two hole punching. A waste flap below the pencil sharpener collects hole puncher blanks and pencil shavings. A punch arm support both supports the punch arm and acts as a hole puncher structure."

The Lissoni Patent is a design patent which issued in March 1993 and expired in March 2007. It discloses a hand-held adhesive tape dispenser which also contains the plastic blade that pushes the tape against the carton and the serrated knife to cut the tape.

The Jasmer Patent discloses the combination of a stapling gun and a cutter. The purpose of the cutter 32 is to cut fiber glass tape inducting after it has been stapled. Therefore, it does not function as a box cutter and is not retractable.

The Tilley Patent discloses the combination of a stapler and a retractable knife formed into a handle mechanism. The stapler includes an actuator that melds at its rear end into a handle and includes a staple holder pivotally attached to the actuator. In use the stapler is grasped by the handle and swung like a hammer. The inertia of the swing depresses the actuator relative the staple holder driving home the uncrimpled staple. In addition, at the opposite end is a retractable knife.

The Taggart Patent discloses a multi-function tool that has multiple purposes. Specifically, the patent discloses:

"A multiple function combination business travel tool combines a plurality of individual business-oriented implements in a single compact and reduced configuration for many diverse business-oriented travel needs. The tool includes a flashlight positioned along a scale, or wide side, fo the tool such that a lightbulb and reflector larger than those provided along the side of prior art tools may be provided. The tool also preferably includes a clock, preferably in the form of a digital alarm clock, and a plurality of deployable implements, preferably selected with the needs of a business traveler in mind. In one embodiment, the tool includes a pair of handles having implement channels and scissor channels, the handles forming the handles of a deployable scissors whose blades are stored in the scissor channels. Deployment of the scissor blades is achieved by rotation thereof about axles by which the blades are respectively coupled to the tool handles, thereby forming scissors with the first and second tool handles functioning as handles of the scissors."

The Johnson Published Patent Application was published in 2003. This patent discloses the concept of a retractable knife blade and a marking tool such as highlighting marker 110 and a pen 112.

The Yu Chen Patent focuses on a unique mechanism of a tape dispenser and a tape cutter. It is a fairly involved mechanism.

The Leu Patent issued in 2005 discloses a ten-in-one tool which has ten different functions. Specifically, the patent. discloses:

"The present invention relates to a ten-in-one pocket stationery unit that is especially suitable for students, office workers and frequent travelers. The pocket stationery unit adopting precision designs and crafty room layout is equipped with ten functions in a single unit, including: a tape measure, a carton opener, a stapler, a hole puncher, scissors, a pencil sharpener, a nail file, and LED lighting, a minus-type and a Philips-type screw driver, a housing defined by a top cover, a bottom seat, an upper partition and a lower partition, to allow easy carriage and to provide convenience."

The Ackeret Patent discloses:

"A multipurpose hand-held implement, comprising at least two components which can be locked in a closed position and then form a compact, essentially closed body, in the case of which the two components, with preferably confluent contours, are directed towards one another. In the closed position, the body forms the handle for actuating utensils, such as a knife, staple remover or cutter, which are accommodated in the components in a set back manner, such that they can be pushed out. The two components are preferably connected to one another in an articulated manner and, after release of the locking means, can be moved relative to one another in order to actuate, for example, a stapler, a hole puncher or a pair of scissors. Further utensils, for example, a magnifying glass, a pointer or a laser pointer may be accommodated in the components."

The Daunter Patent is a design patent that issued in 2006 and is owned by Henkel Consumer Adhesives, Inc. and is a design patent on a tape dispenser. It protects the way the tape dispenser looks. It does not have the general resemblance of the slide mechanism to hold the tape and the handle.

The Cetera Design Patent discloses the shape of a combination stapler and dispenser.

The Cetera Published Patent Application discloses the combination of a stapler and a tape dispenser. The object of the invention is to dispense any type of fastening means such as staples or brand nails. The device has the combination of the staples and tapes but is different from your invention.

Published issued in December 2006 and is a combination stapler, tape dispenser and flag dispenser which includes a stapler having a housing including first and second arms joined together at a pivot. The stapler which is basically vertically aligned and is shown at the combination 12 and 16 and is operated by pressing the two handles together to cause the staple to be ejected and stapled to the object. The dispensing mechanism is better illustrated in FIG. 5. The device also includes on the opposite side, a tape dispenser. The tape dispenser 62 includes a cutting blade 81 disposed at an end 79 of the concave contour. A roll of tape 70 is discharged from the top portion of the device and extends out the tape dispenser 62. The device also includes a flag dispenser 84 for dispensing flags 92. Looking at the claims, claim 1 claims the combination of a stapler, a tape dispenser and a flag dispenser. The second independent claim, claim 6, discloses a combination flag dispenser combined with a stapler. The third independent claim, claim 12 claims the combination of a stapler and a tape dispenser.

The Nutall Design Patent also discloses a combination staple/tape dispenser.

The Grepper Published Patent Application discloses a combination of a vertically standing stapler and tape dispensing device.

The Johnson Patent discloses a multi-tasking utility tool. It has the combination of having a knife and a marker. It also has required electronics with it.

The Barker Published Patent Application discloses a combination tool which includes a combination wrench, screwdriver, pliers, etc.

The Delneo Published Patent Application discloses a stapler with a blade cartridge for securing a blade. A reloadable staple cartridge 18 enables a supply of staples to be induced into stapler 10 and holds the staples in place within handle 14 and head 12 such that the staples can be dispensed from the stapler dispenser 22. A reloadable staple cartridge 28 extends into the handle 14. In addition, referring to FIG. 2, blade cartridge 34 is positioned and is movable within head 12 from rest position shown in FIG. 2 to an in use position at which the blade cartridge 34 is slid toward the slot 24 to be extended outwardly so that the blade 40 can be used as a cutter. Therefore, this patent discloses and claims a staple dispenser and a blade cartridge.

The Sandy Published Patent Application discloses:

"A desk or office accessory, such as an adhesive tape dispenser, has a base holding one, two or more smaller office sub components or devices that may be removed from the base, used as preferred, and then optionally returned or reattached to the base. The sub-components may be, for example, a calculator, a staple remover, a letter opener, etc. The sub-components may be attached to the base via magnets, Velcro hook and loop tape, fasteners, adhesive areas, etc. The base may include areas intended to be printed with or holding an image, such as a photograph, artwork, corporate logo, etc."

In Section 17, the patent application states:

"Referring to FIG. 6, in place of, or in addition to, the letter opener 31, a stapler 40 may be provided in or on the body 11. The stapler 40, if included, typically has a slot opening in the body 11, like the letter opener 31. A switch 42 in the slot activates a stapling mechanism 44 when contacted by papers inserted into the slot. As shown in FIG. 1, the body 11 may be formed by separate top and bottom shells or halves, separated by a parting line 60. This allows the body 11 to be opened up to load staples into the stapler 40. Also as shown in FIG. 1, a flag or posit dispenser may be provided on the body 11."

The Huang Published Patent Application discloses a tape dispenser equipped with an extra tool. This published patent application was published in March 2008 and is still pending. Referring to FIG. 1, a tape dispenser is shown which includes a handle 10 having a top and bottom, base plate 12 fixed on the top of the handle 10, a tape reel 14 pivoted on the rear of the base plate 12, a roller 16 and a seat 18 mounted on the front of the base plate 12. The seat is provided with a cutter 20 and a plate 22. This is similar to your portion of the invention. The handle contains a chamber into which is inserted a tool which is described as a utility knife. Specifically, referring to Section 20, the patent states:

"The main scope of the present invention is that we don't change the structure of the conventional tape dispenser, and we just use the useless space in the handle to store a tool that increases the practicability of the tape dispenser much."

The Kwok Design Patent protects the shape of the tape dispenser.

The Cetera European Patent is a multi-function fastening device similar to previous devices that have been discussed that contains both the tape dispenser and a stapler.

There is a significant need to provide a combination tool, which can conveniently and effectively assist in packaging parcel packages.

SUMMARY OF THE INVENTION

The present invention is a four-in-one multi-component combination tool which has a combination of four features all combined into one tool to facilitate enclosing cartons and boxes such as parcel packages and also has the added features of a box cutter to cut up unused boxes and/or cut off flaps off of boxes and also a marker to mark the box or package after it is enclosed. The present invention is a combination tool for assisting in packaging parcel packages, comprising a tape roll assembly, a built-in extendable and retractable blade knife which functions as a box cutter, a stapler and an extendable and retractable marker which is also replaceable with a new marker or a different color marker for color coding, and which are integrated to effectively and conveniently assist in packaging activities.

The key difference between the present invention and the prior art is that the present invention combines four tools into one unique tool which is designed in an easy-to-use manner. The prior art has various subcombinations of the tools used and incorporated into the present invention but the prior art tools do not have the unique four-in-one combination with all four components of the present invention oriented in an easy-to-use manner which facilitates the forming of a carton or box, and enclosing the carton or box after the carton or box has been filled.

The combination tool is comprised of a longitudinal handle connected to a rectangular support at the top of the handle, which rectangular support member functions as an upward plate to support the tape roll assembly, stapler and built-in box cutter. In addition, the tool handle serves as a housing for the extendable and retractable marker.

The tape roll assembly is comprised of a tape roll mounted into a roll mount affixed to a second side of the rectangular support, a directional wheel, a spring loaded clamp, an outward replaceable senate blade and a plastic blade. The directional wheel and the spring loaded clamp function to guide a tape in a pulling movement during unrolling of the tape. The plastic blade presses the tape against a package to secure adhesion of the tape to the package. The senate blade can cut off the tape after the appropriate amount of tape has been affixed to the given location on the package.

The extendable and retractable blade knife or box cutter is positioned inside of a transverse housing attached on a first side of the upward rectangular support plate, wherein a first end of the housing is aligned with a first upward side of the support plate. The knife is connected to a transverse knob penetrating through a slot in the housing. Therefore, the blade of the box cutter will extend out of the housing if the knob is moved towards the first end of the housing, so that the box cutter blade can be used to cut off portions of the cartons of the packages or cut up unused package or reopen the carton to add additional items or take items out that have been incorrectly loaded or packaged.

The extendable and retractable marker is positioned inside of a longitudinal opening in the tool handle, wherein the marker is connected to a transverse knob penetrating through a longitudinal slot of the handle. Therefore, the head of the downwardly extending marker will extend downwardly out of the handle bottom if the knob is moved in the downward direction so that the marker can be used to label packages.

The combination tool further comprises the built-in stapler so that packages can be conveniently stapled during the initial assembly of the bottom of the carton or package and also have tape applied if necessary and after the package is filled, the top of the carton or package is enclosed with staples and tape for heavier shipments. The present invention permits stapling and taping to occur simultaneously.

It is an object of the present invention to provide a combination tool for assisting in packaging parcel packages, comprising a tape roll assembly, a built-in extendable and retractable blade knife or box cutter, a stapler and an extendable and retractable marker, so that the integrated tool can effectively and conveniently assist packaging activities, and reduce loss of these individual tools, thus saving time.

It is also an object of the present invention to a combination tool comprising a longitudinal handle connected at its top end to a transverse support that is an upward plate, so that the tape roll assembly, stapler and built-in blade knife can be positioned onto the support. In addition the tool handle serves as a housing for the extendable and retractable marker It is an additional object of the present invention to provide a tape roll assembly which is comprised of a tape roll mounted into a roll mount affixed to a second side of the rectangular support, a directional wheel, a spring loaded clamp, an outward replaceable senate blade and a plastic blade. Therefore, the directional wheel and the spring loaded clamp function to guide a tape in a pulling movement during the process of unrolled a length of tape from the tape roll. The plastic blade presses the tape against a package to secure adhesion of the tape to the package, and the senate blade can cut off the tape after the appropriate amount has been unrolled and applied to the package.

It is a further object of the present invention to provide an extendable and retractable blade knife or box cutter that is positioned inside of a transverse housing attached on a first side of the upward rectangular support plate, wherein a first end of the housing is aligned with a first upward side of the support plate. In addition, the blade of the box cutter is connected to a transverse knob penetrating through a slot in the wall of the housing. Therefore, the blade of the box cutter will extend out of the housing if the knob is moved towards the first end of the housing, so that the box cutter blade can be used to cut off unused sections of cartons or cut up unneeded cartons.

It is still a further object of the present invention to provide an extendable and retractable marker that is positioned inside of a longitudinal opening of the tool handle, wherein the marker is connected to a transverse knob penetrating through a longitudinal slot in the handle. Therefore, a head of the downwardly extending marker will extended out of the handle bottom if the knob is moved in the downward directions so that the marker can be used to label packages. The marker is also replaceable so that a new marker can be inserted when the old marker is used up.

It is additional object of the present invention to provide a built-in stapler, so that packages can be conveniently stapled during parcel packaging.

The present invention is further a tool for assisting a worker with boxing and shipping cargo, which tool includes a housing having a handle depending therefrom. Adjacent the handle is a reciprocal trigger that operates an internal geared staple driver for installing staples within a shipping container. The housing also includes an integral tape dispenser, a deployable marker and a retractable box-cutting blade.

It is therefore an object of the present invention to provide a tool that eliminates the burden and inconvenience associated with preparing shipping containers.

It is another object of the present invention to provide a tool that combines the features and advantages of a tape dispenser, a box cutter, a heavy-duty self-curling stapler and a marker.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
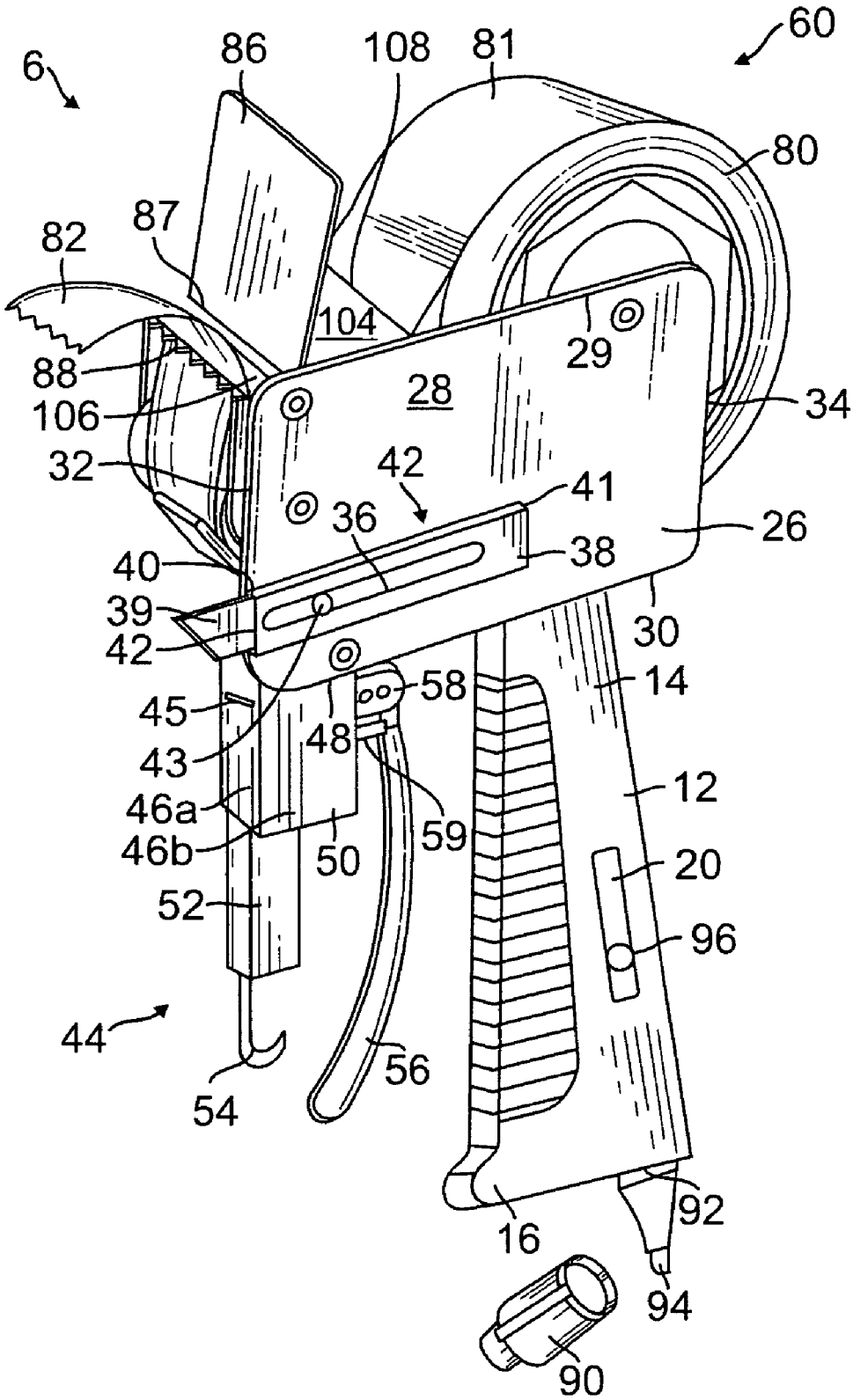
FIG. 1 is a perspective view of a first preferred embodiment of the present invention four-in-one combination tool for assisting in packaging parcel packages.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a combination tool for forming a carton or package by enclosing a bottom end and enclosing the top end of the package or carton after it has been filled, the combination tool comprising a tape roll assembly, a built-in blade knife or box cutter, a stapler and a marker, which are integrated to effectively and conveniently assist in packaging activities.

The present invention relates to a tool for preparing shipping containers. The device comprises a housing having a front surface, a rear surface, a lower surface, a top surface and two opposing sides. Depending from the lower surface is a handle with a reciprocal lever adjacent thereto. The lever is operably connected to a geared staple driver of the type typically found in a conventional heavy-duty stapler. Likewise, depending from the lower surface of the housing is a staple magazine having a spring-biased feeder therein that automatically propels a strip of staples into the geared driver. On a side of the housing is a tape hub for receiving a conventional roll of packaging tape. The tape is fed between a roller and a spring-biased damp that prevents the tape from inadvertently unrolling.

On the upper surface of the housing is an angularly extending blade that presses the tape against a container, and which severs it when a desired amount of tape has been dispensed. A slidable lever positioned on one of the housing sidewalls deploys and retracts a box cutter blade. The box cutter blade is preferably formed of multiple perforated sections so that the leading edge of the blade may be removed and discarded if it dulls. A second slidable lever is positioned on the handle that deploys and retracts a marker through an opening on the lower surface of the handle. Accordingly, a worker can tape, cut and inscribe a shipping container with a single tool.

The above described device is not limited to the exact details of construction and enumeration of parts provided herein. Furthermore, the size, shape and materials of construction of the various components can be varied.

Referring to FIGS. 1-6, there is illustrated a first preferred embodiment 6 of the present invention combination tool for assisting in packaging parcel packages. The combination tool 6 is an integrated four-in-one tool, comprising a longitudinal tool handle 12 connected at its top end to an upper rectangular support 26 that supports a tape roll assembly 60, a built-in box cutter 42 with blade knife 39, a stapler 44, wherein the tool handle 12 also serves as a housing for an extendable and retractable marker 92.

Figure 3:
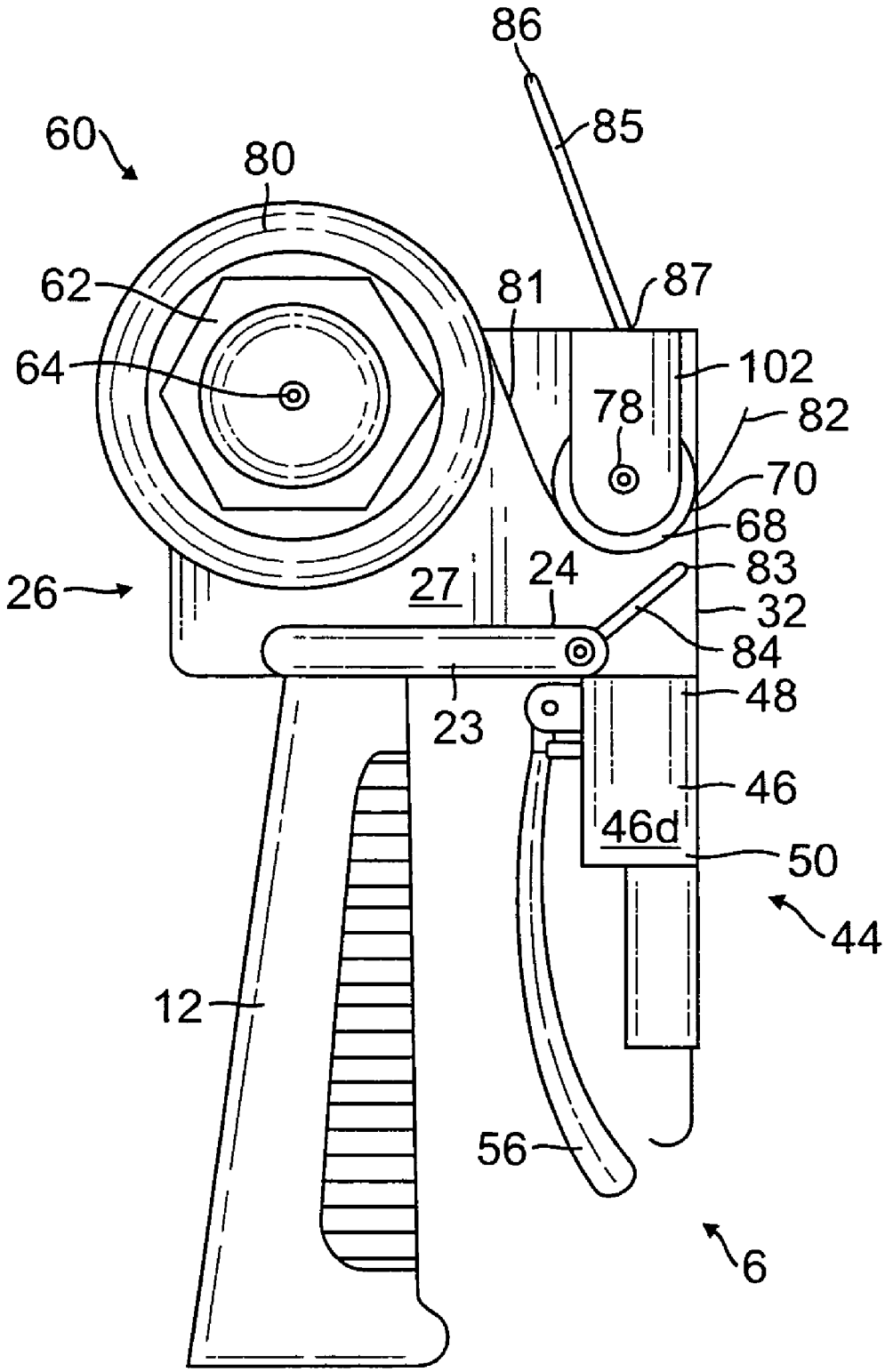
FIG. 3 is a rear view of the combination four-in-one tool of the present invention, illustrating the marker retracted into the handle of the tool, as compared with the marker head in the extended condition which is shown in FIG. 2.

The tool handle 12 is generally a longitudinal hollow member comprising an upper end 14, a lower end 16, and a longitudinal slot 20 that is positioned approximately at the longitudinal middle of the handle 12. The handle 12 at the upper end 14 is affixed to the upper rectangular support 26. As illustrated in FIG. 3, the affixation is further strengthened by a transverse beam 23, positioned at the joint where that handle and support 12 and 26 are connected. The tool handle 12 can be injection molded using polypropylene plastic and is supplied with a non-slip grip. The molded plastic handle can function as the base for all the metal used to hold the subcomponents.

The rectangular support 26 is an upward plate comprising rear and front faces 27 and 28 which are bounded by upper and lower longitudinal sides 29 and 30, each of which extend along the rectangular length of each face, and first and second vertically extending sides 32 and 34. The rectangular support 26 is connected to the upper end 14 of the longitudinal handle at the location of the rectangular support 26 adjacent longitudinal side 30 and vertically extending side 34.

Figure 2:
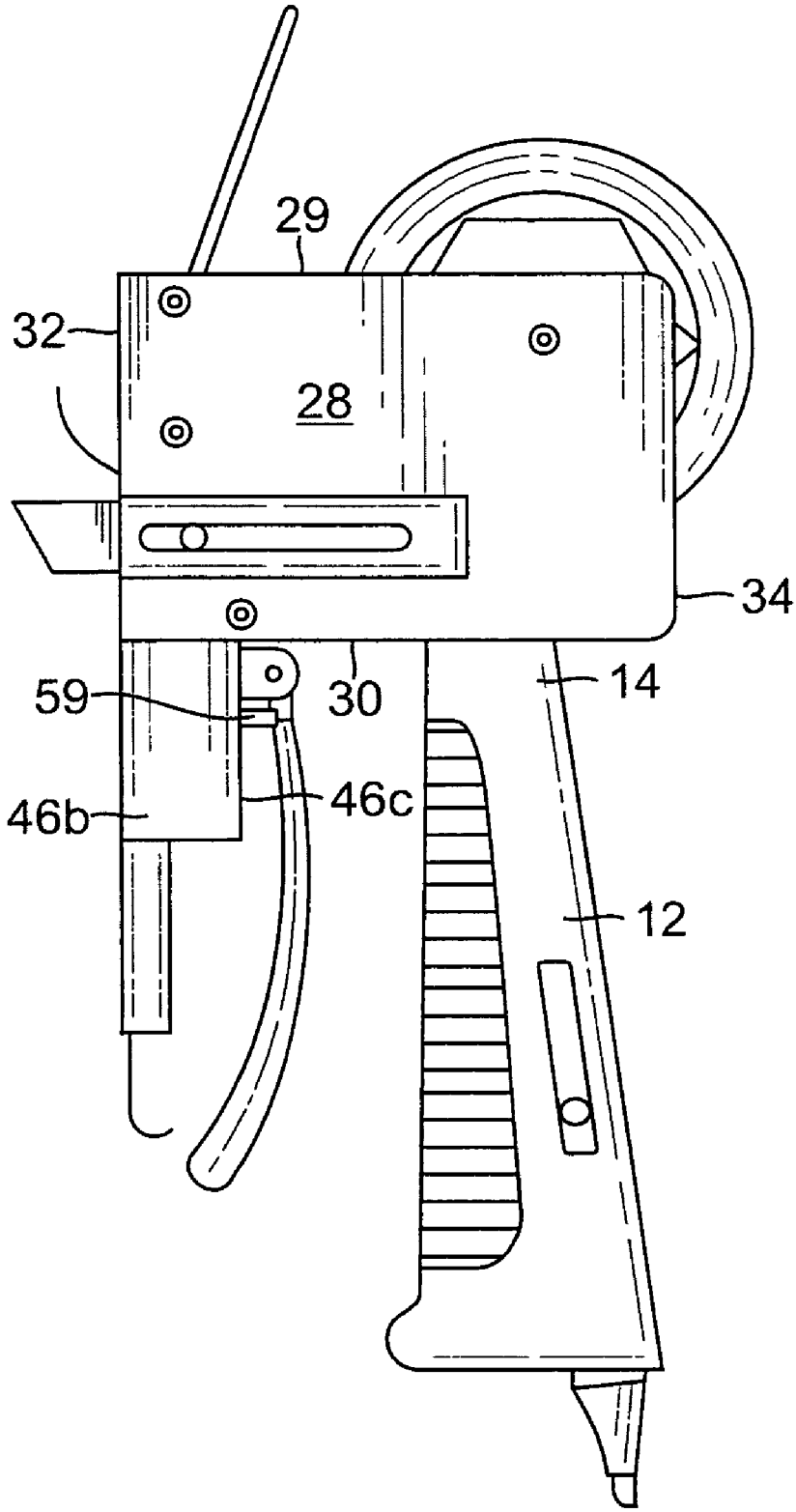
FIG. 2 is a front view of the combination four-in-one tool of the present invention, which is taken from FIG. 1 illustrating the marker in the extended and in use condition.

Referring to FIGS. 1 and 2, there is illustrated the built-in extendable and retractable box cutter 42 with blade knife 39. The blade knife 39 is slidably positioned inside of the box cutter 42 which has a transverse rectangular housing 38 having first and second ends 40 and 41, the rectangular housing 38 positioned on the front side 28 of the rectangular support 26, wherein the first end 40 is aligned with the first vertically extending side 32 of the support 26. As illustrated, a transverse slot 36 having left and right ends is a positioned on a front side of the housing 38, wherein the first end of the slot 36 is adjacent the first vertically extending side 32 of the support 26. A transverse knob 43 extends through the slot 36 and is connected to the knife 42. Therefore, as the knob 43 moves towards the first end of the slot, the blade knife 39 of the box cutter 42 also extends out of the first end 40 of the housing 38. The box cutter blade knife 39 is retracted inside of the housing 38 which the knife knob 43 is moved adjacent the second end of the slot 36. It is also within the spirit and scope of the present invention for the box cutter 42 to have a blade knife which is break-away. Replacement blades are readily available at most hardware, lumber, home improvement stores and on the internet from the manufacturer.

It will be appreciated that, the box cutter 42 with blade knife 39 when the blade knife 39 is positioned outside of the housing 43, can be used to cut flaps off cartons by the user when the parcel packages are sealed and/or can be used to cut up used boxes. Therefore, the combination tool 6 provides a box cutter feature incorporated into the four-in-one tool of the present invention.

Figure 4:
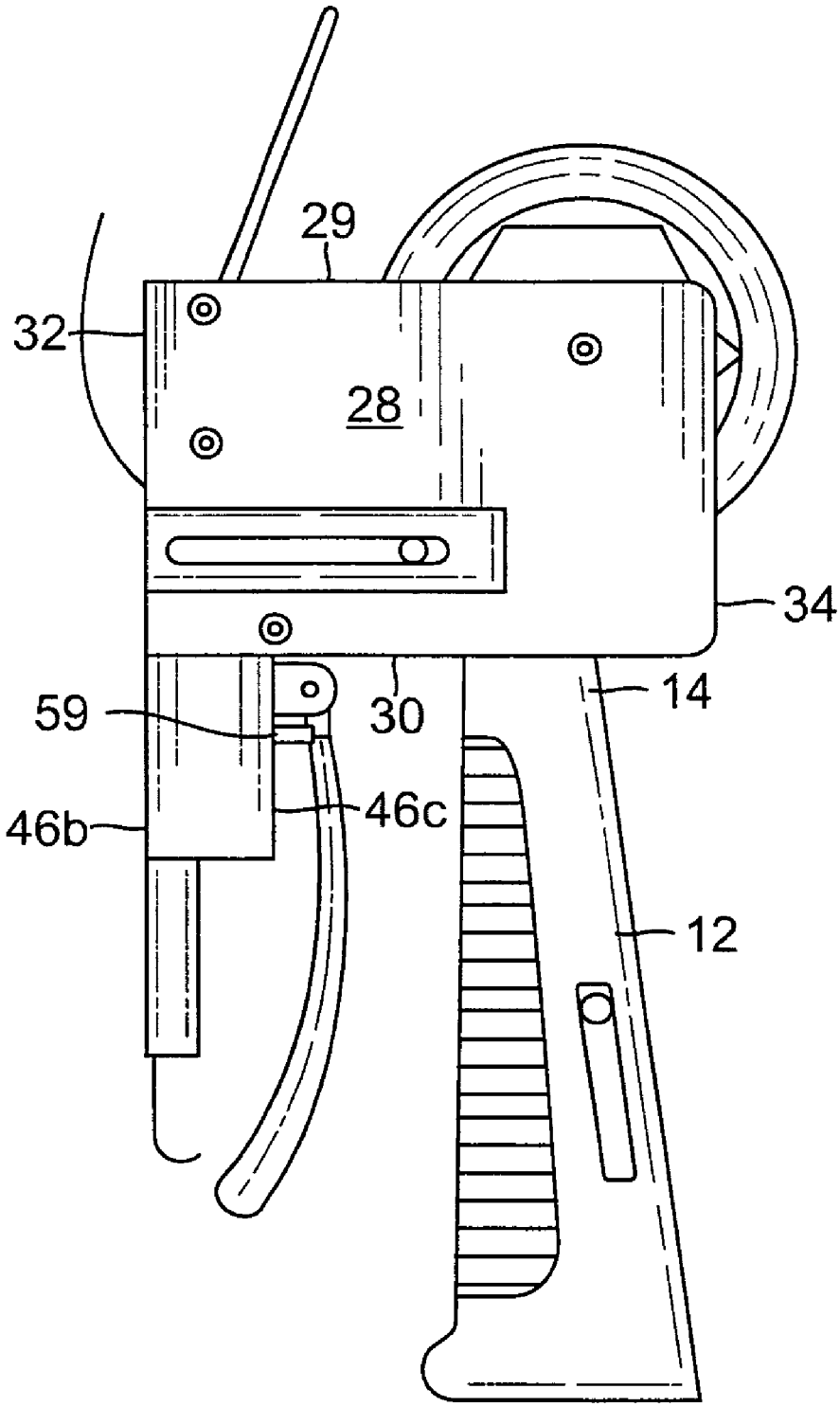
FIG. 4 is a front view of the present invention four-in-one combination tool shown in FIG. 3.

Referring to FIGS. 1, 2 and 4, there is illustrated the longitudinally extendable and retractable marker 92, positioned inside of a longitudinal opening of the handle 12 that serves as a housing for the marker 92. As illustrated, on a front side of the handle 12, there is formed a longitudinal slot 20 having upper and lower ends, wherein the lower end of the slot 20 is adjacent the handle lower end 16. A transverse knob 96 extends through the slot 20 and connects to the marker 92. Therefore, when the user moves the knob 96 down, a marking had or marking tip 94 of the marker 92 extends out of the lower end 16 of the handle 12. At this time the marker can also be removed and replaced. The marker 92 is retracted inside of the handle 12 if the marker knob 96 is moved upward to adjacent the upper end of the slot 20, which is remote to the handle lower end 16.

To keep the marker fresh, the marker tip or head 94 is covered with a head cover 90. It will be appreciated that the marker head 94, when it is positioned outside of the handle 12 after removing a head cover 90, can be used to label the parcel packages by the user during parcel packaging. Therefore, the combination tool 6 provides a labeling ability and feature incorporated into the present invention. The markers are available at most stationery, drug and office supply stores. After use, the cap is snapped onto the marker, it is inserted into the carrier and then it is retracted into the handle using the slide mechanism Referring to FIGS. 1 to 3, there is illustrated the third functional component of the four-in-one combination tool of the present invention which is a tape roll assembly 60 of the present invention. The assembly 60 is comprised of a tape roll 80 mounted on a tape roll mount 62, a directional wheel 68, a spring loaded clamp 84, a replaceable senate blade 88, and an upper plastic guide blade 85.

The tape roll mount 62 is affixed to the rear face 27 of the rectangular tool support 26, through a transverse tape mount fastener 64 that penetrates through a center of the mount 62 to affix to the rear face 27 of the tool support 26. As illustrated, the roll mount 62 is positioned at the northeast corner of the support 26.

Referring to FIG. 3, the tape directional wheel 68 having an exterior circumferential side 70 is rotatably positioned on the rear face 27 of the rectangular support 26 adjacent the middle of the first vertically extending side 32. The rotatable affixation of the wheel 68 is conducted through a transverse fastener 78, which serves as a rotational axle of the wheel 68. The fastener 78 penetrates and extends through a plastic blade support 102 and the wheel center to thereby be affixed onto the rear face 27 of the tool support member 26. The plastic blade support 102 is comprised of a downward section connected to a transverse section 104 having outward and inward sides 106 and 108.

As further illustrated in FIG. 3, a spring loaded clamp 84 having an upper end 83 and a lower end is positioned below but adjacent the directional wheel 68, wherein the upper end 83 touches the wheel exterior circumferential side 70. The clamp lower end, which serves as the rotational center of the clamp 84, is rotatably positioned at a first end 24 of the transverse beam 23 which is positioned at the rear side 27 of the support 26.

As additionally illustrated in FIGS. 1 and 3, the upper plastic blade 85 has a spatial upper end 86 and lower end 87. The lower end 87 is affixed to the top of the transverse section 104 of the plastic blade support 102. The replaceable senate blade 88 is positioned at the northwest corner of the support member 26, wherein the outward blade 88 is connected to the outward side 106 of the transverse section 104 of the plastic blade support 102.

Having the above disclosed structural members and referring to FIG. 3, it will be appreciated that a section of a roll of tape 81 having a first end 82 extends from the tape roll 80 and rotates in the clockwise direction when viewed from FIG. 3 and turns down to pass between the exterior circumferential side 70 of the directional wheel 68 and the upper end 83 of the spring loaded clamp 84. The tape first end 82 continually extends around the exterior circumferential side 70 and moves up to pass the senate blade 88. In this setting, the tape roll assembly 60 of the tool 6 is ready for use.

It will be appreciated that during taping a parcel package, the user first holds the tool handle 12 to cause the adhesive layer of the tape 81 to face the package. The user then presses the tape section adjacent the first end 82 to make the adhesive layer touch the surface of the package by applying the upper end 86 of the plastic blade 85 against the package. This results in causing the tape adhesive layer to adhere to the exterior surface of the parcel package. Once the tape first end 82 is securely bonded to the package, the user then pulls the combination tool 6 towards the user's body, so that the tape is continually pulled off from the tape roll 80. During the tape movement, the upper end 83 of the spring loaded clamp 84 presses the tape 81 against the exterior circumferential side 70 of the directional wheel 68 to thereby prevent the tape 81 from unrolling.

Once the package is taped, the user can cut off the tape 81 by applying the outward senate blade 88. Therefore, a new tape spatial head 82 is formed, and the tape roll assembly 60 is ready for the next use. Therefore, the taping feature is another component of the four-in-one combination tool of the present invention.

The tape roll assembly accepts standard 48 mm wide by 50 mm long super strength packing tape rolls, dispenses it and cuts the tape. The tape is loaded onto the support by sliding it over the hub and then it is threaded out over the roller with the adhesive outward. The tape is cut with the replaceable serrated blade mounted on the front of the machine. The spring loaded clamp prevents the tape from unrolling.

Referring to FIGS. 1-6, there is illustrated stapler 44, comprising a hollow body 46 having a transverse slot 45 which functions as an opening through which staples are ejected, a cartridge of staples 52, a spring loaded feeder 54, and handle 56 connecting a staple knife 59.

The stapler body 46 is rectangular, having an outward side 46*a*, a front side 46*b*, an inward side 46*c* and a rear side 46*d*. The body 46 is further comprised of an upper end 48 and a lower end 50. The body upper end 48 is affixed to the lower longitudinal side 30, wherein the outward side 46*a* of the body is aligned with the first vertically extending side 32. In addition, the transverse slot 45 is positioned on the outward side 46*a* adjacent the upper end 48 of the stapler body 46. The stapler trigger handle 56 is rotatably connected to the body 46 of the stapler 44 through a rotatable joint 58, wherein the connection takes place on the inward side 46*c* adjacent the body upper end 46. The handle 56 connects to the transverse staple ejector or knife 59, which is positioned below but adjacent the rotatable joint 58. The cartridge of staples 52 is upwardly inserted into the hollow body 46, and is further locked by the spring loaded feeder 54. Therefore, the built-in stapler 44 is ready for use.

Figure 5:
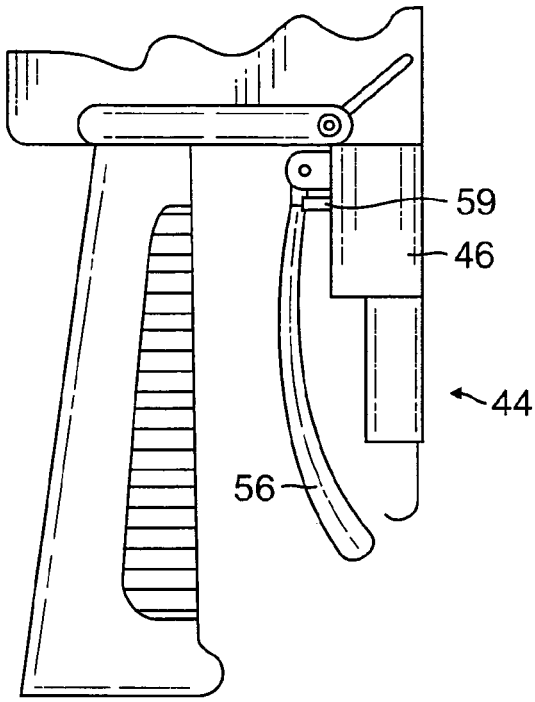
FIG. 5 is a partial rear view of the first preferred embodiment of the four-in-one combination tool, which illustrates the built-in stapler in the unactivated condition.
Figure 6:
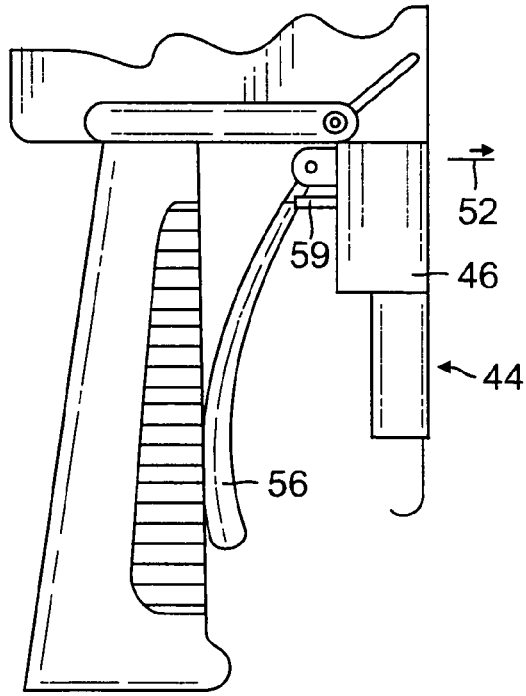
FIG. 6 is the same partial rear view in FIG. 5, which illustrates the built-in stapler in the activated condition.

As particularly illustrated in FIGS. 5 and 6, for the staple trigger mechanism, when the user pulls inwardly on the stapler trigger handle 56 so that the trigger handle rests adjacent the body 12, it activates the staple ejector knife 59, so that a staple 52 is pushed out through the transverse slot 45 to fasten two sections of the package together in a conventional manner. Therefore, this stapling feature is the fourth tool in the combination four-in-one present invention.

By way of example, the stapler accepts ⅝ inch copper clad top carton closing staples. The stapler takes ½ of a normal strip of ⅝ inch copper clad staples because of its compact length. The staples are slipped into the magazine and are pushed into the stapler by the spring loaded feeder. The specially constructed geared mechanism drives the staple through the carton from the top side and then deploys two arms to clinch the staple inside the box, just like top carton staplers. The operator simply places the combination tool against the carton and pulls the handle back to fasten the staple.

Figure 7:
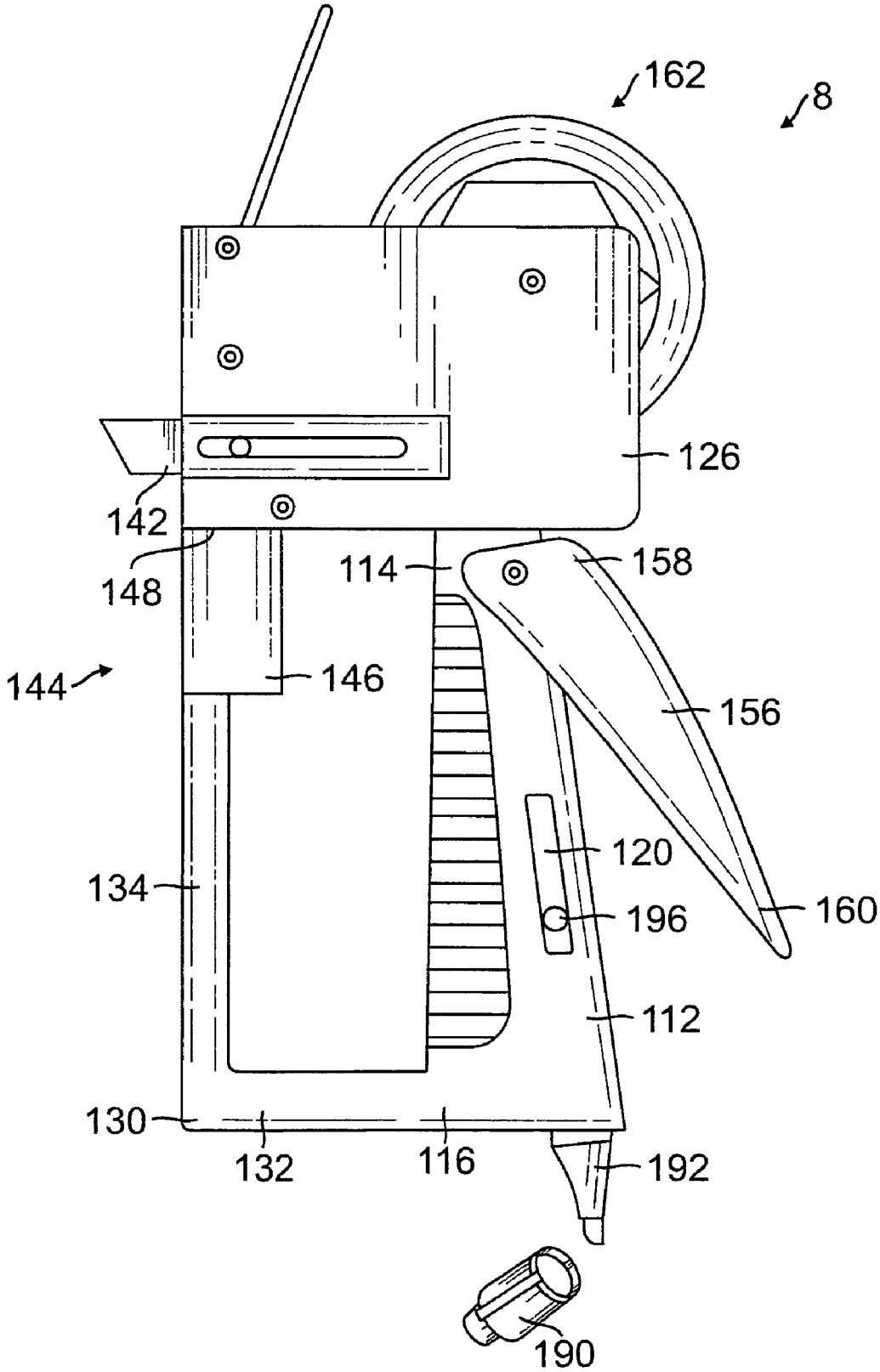
FIG. 7 is a front view of a second preferred embodiment of the present invention.

Referring to FIG. 7, there is illustrated second preferred embodiment 8 of the present invention combination tool. Comparing the first preferred embodiment 6 shown in FIG. 2 with the second preferred embodiment 8 in FIG. 7, it will be appreciated that, the structural difference between two embodiments is that the second embodiment 8 applies an arm to link the stapler 44 and tool handle 12 of the first embodiment, in addition to have a stapler handle positioned onto the tool handle 12.

As illustrated in FIG. 7, the second embodiment 8 of the present invention combination tool is also an integrated one, comprising a longitudinal tool handle 112 at the top connected to an upper rectangular support 126 that supports a tape roll assembly 162, a built-in box cutter or blade knife 142, a stapler 144 having a body 146 and a staple knife. The tool handle 112 has a longitudinal slot 120, which also serves as a housing for an extendable and retractable marker 192 having a cover 190 connected to a transverse knob 196, through an arm 130 connects to the stapler body 146.

It will be appreciated that, within structural members of the second embodiment 8, the tape assembly 160, the built-in box cutter or blade knife 142, the marker 192 including the slot 120 and the knob 196, the stapler body 146 including the staple knife, and the tool handle 112 that serves as the marker housing, and the upper rectangular support 126 are identical as compared with the respective structure of the first embodiment 4. Therefore, for simplifying disclosure of the present invention, these identical structure will not be repeated again.

As illustrated, the tool handle 112 is almost identical to the tool handle 12 of the first embodiment, except for (1) the arm 130 linked to a bottom 116 of the handle 112 and (2) a stapler handle 156 rotatably positioned adjacent an upper end 114 of the tool handle 112, which is connected to the upper tool support 126.

The arm 130 is comprised of a transverse section 132 connected to a longitudinal section 134, wherein the transverse section 132 further connects to the bottom 116 of the tool handle 112, and the longitudinal section 134 further connects to a lower end 150 of the body 146 of the stapler 144. Therefore, the combination tool 8 has an enclosed structural configuration for mechanical strength enhancement.

The stapler 144 is comprised of the body 146 having an upper end 148, a cartridge of staples, a spring loaded feeder, a staple handle 156, wherein the cartridge of the staples incorporated with the spring loaded feeder and knife are positioned inside of the body 146 and the arm longitudinal section 144. The staple handle 156 is comprised of upper and lower end 158 and 160, wherein the upper end 158 of the handle 156 is rotatably affixed to the upper end 114 of the tool handle 112. It will be appreciated that, the second embodiment 8 is further comprised of a internal mechanism to activate the staple knife, when the handle 156 is clockwise pressed. In this configuration, the stapler 144 of the second embodiment can function as a conventional staple gun to staple packages.

The four-in-one tool of the present invention combines features of the prior art into one simple and easy-to-use tool that quickly, efficiently and ergonomically combines in one object a single four-in-one tool that has all of the individual components needed to create and close cartons and boxes. The transverse ends of a box or carton are folded inwardly and then the longitudinal sections are folded over the transverse ends. The longitudinal ends are then fastened together by first stapling and then taping or first taping and then stapling so that the bottom of the box or carton is formed. The box or carton is then filled and the transverse ends are folded inwardly and longitudinal sections folded over the transverse ends and then the longitudinal sections are fastened together by stapling and taping or taping and stapling. An excess portion of carton can be cut away by using the box cutter. Any writing on the box or carton can be made with the marker. Therefore, all four tools needed for assembly of the box or carton such as for parcel post or post office use are readily available in one simple to use four-in-one tool. The present invention can be used for commercial use or for in-home consumer use as well.

While primarily considered a four-in-one tool, it is also within the spirit and scope of the present invention to have the combination of only three components, the tape assembly, the box cutter and the stapler and eliminate the marker.

Defined in detail, the present application is a combination tool, comprising: (a) a tape roll assembly, a box cutter, a stapler and a marker; (b) a tool handle having an upper end which is attached to a tape support member which supports the tape roll assembly having a roll of tape mounted on a rotatable axle, a spring loaded clamp, a senate blade and a guide blade; (c) a box cutter housing affixed at a location on the tape support member and including an activation and retraction mechanism to enable a blade of the box cutter to extend out of the housing when in use and be retracted into the housing when not in use; (d) the marker retained within the handle and including an activation and retraction mechanism which enables the marker to extend out of the handle when in use and be retracted back into the handle when not in use; and (e) the stapler including a stapler housing affixed at a location on the tape support member, the housing retaining a staple cartridge and an opening through which staples are ejected from the housing and a trigger activation mechanism which causes a staple to be ejected from the housing upon activation of the trigger mechanism.

Defined more broadly, the present application is a combination tool, comprising: (a) a tape roll assembly, a box cutter, a stapler and a marker; (b) a tool handle attached to a tape support member which supports the tape roll assembly having a roll of tape mounted on a rotatable axle; (c) a box cutter housing affixed at a location on the combination tool member and including an activation and retraction mechanism to enable a blade of the box cutter to extend out of the housing when in use and be retracted into the housing when not in use; (d) the marker retained within the handle; and (e) the stapler including a stapler housing affixed at a location on the combination tool, the housing retaining a staple cartridge and an opening through which staples are ejected from the housing and a trigger activation mechanism which causes a staple to be ejected from the housing upon activation of the trigger mechanism.

Defined even more broadly, the present application is a combination tool, comprising: (a) a tape roll assembly, a box cutter, and a stapler; (b) a tool handle attached to a tape support member which supports the tape roll assembly having a roll of tape mounted on a rotatable axle; (c) a box cutter housing affixed at a location on the combination tool member and including an activation and retraction mechanism to enable a blade of the box cutter to extend out of the housing when in use and be retracted into the housing when not in use; and (e) the stapler including a stapler housing affixed at a location on the combination tool, the housing retaining a staple cartridge and an opening through which staples are ejected from the housing and a trigger activation mechanism which causes a staple to be ejected from the housing upon activation of the trigger mechanism.

Defined even more broadly, the present invention is a combination tool comprising a tape roll assembly, a box cutter, a stapler and a marker.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A combination tool, comprising:

a. a tape roll assembly, a box cutter, a stapler and a marker which is operable by one hand and used to form a carton and enclose the carton after it has been filled;

b. a generally longitudinal hollow tool handle having an upper end which is attached to a rectangular tape support member which supports the tape roll assembly, the tape roll assembly having a roll of tape mounted on a rotatable axle, a spring loaded clamp, a senate blade and a guide blade;

c. the tape support member formed as a rectangular plate comprising rear and front faces each of which are bounded by upper and lower longitudinal sides and each of which extend along the rectangular length of each face, and first and second vertically extending sides, the tape support connected to the upper end of the longitudinal handle at a location of the rectangular support adjacent a longitudinal side and a vertically extending side;

d. the tape roll mounted on the rotatable axle being affixed to the rear face of the rectangular tape support member through a transverse tape mount fastener that penetrates through a center of the mount to affix the tape roll to the tape support member;

e. a box cutter with a blade knife slidably positioned inside of a box cutter housing affixed on the front side of the rectangular tape support member and including an activation and retraction mechanism to enable the blade knife of the box cutter to extend out of the housing when in use and be retracted into the housing when not in use, the blade knife is slidably positioned inside a transverse rectangular housing having first and second ends, the rectangular housing having a transverse slot with a transverse knob extending through the slot, the transverse knob connected to the blade knife, the blade knife moved in and out of the rectangular housing of the box cutter by movement of the transverse knob;

f. the marker retained within the handle and including an activation and retraction mechanism which enables the marker to extend out of a lower end of the handle when in use and be retracted back into the handle when not in use, the marker being removable and replaceable, the marker is housed within a hollow opening in the handle, the handle having a longitudinal slot having upper and lower ends wherein the lower end of the slot is adjacent the lower end of the handle, a transverse knob extending through the slot and connected to the maker so that when the knob is moved down in the slot, a marking tip of the marker extends out of the lower end of the handle and when use is competed the transverse knob is moved upward in the slot to retract the marking tip back into the tool handle;

g. the stapler including a stapler housing having an upper end affixed to the lower longitudinal side of the rectangular tape support member, the housing retaining a staple cartridge and an opening through which staples are ejected from the housing and a trigger activation mechanism which causes a staple to be ejected from the housing upon activation of the trigger mechanism, the trigger activation mechanism operatably connected to a staple ejector knife which pushes the staples out of the cartridge when the trigger mechanism is activated; and wherein the tool operable in one hand to enclosed a carton by activation of the taping mechanism to tape a bottom of a carton closed and activation of the stapler to staple the carton closed, the marker caused to extend out of the handle so that the marker is used to mark the carton, and the blade knife is used to cut and trim the carton.

* * * * *